US006422557B1

(12) United States Patent
Kakigi

(10) Patent No.: US 6,422,557 B1
(45) **Date of Patent: *Jul. 23, 2002**

(54) IMAGE FORMING APPARATUS HAVING A PLURALITY OF SHEET STACKING MEANS

(75) Inventor: Nobuyoshi Kakigi, Sakura (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,055

(22) Filed: Sep. 8, 1998

(30) Foreign Application Priority Data

Sep. 12, 1997 (JP) ..... 9-248514

(51) Int. Cl.[7] ..... B65H 39/10
(52) U.S. Cl. ..... 271/294; 271/288
(58) Field of Search ..... 271/288, 294, 271/292, 298, 65

(56) References Cited

U.S. PATENT DOCUMENTS 4,648,591 A * 3/1987 Osmera et al. ..... 271/305
4,759,448 A * 7/1988 Kawabata ..... 271/294 X
5,013,027 A * 5/1991 Furukawa ..... 271/290
5,172,908 A * 12/1992 Steinhilber ..... 271/288
5,188,354 A * 2/1993 Emori ..... 271/217
5,215,298 A * 6/1993 Stemmle et al. ..... 271/65
5,318,401 A * 6/1994 Mandel ..... 414/792.7
5,328,169 A * 7/1994 Mandel ..... 271/298 X
5,346,203 A * 9/1994 Stemmle ..... 271/288
5,358,238 A * 10/1994 Mandel et al. ..... 271/298
5,390,910 A * 2/1995 Mandel et al. ..... 271/296
5,435,544 A * 7/1995 Mandel ..... 271/298
5,455,667 A * 10/1995 Hiroi et al. ..... 271/288 X
5,590,871 A * 1/1997 Okabe et al. ..... 270/58.27
5,752,697 A * 5/1998 Mandel et al. ..... 271/288
5,777,882 A * 7/1998 Salgado ..... 271/298 X
5,946,541 A * 8/1999 Kakigi ..... 399/405

* cited by examiner

*Primary Examiner*—Christopher P. Ellis
*Assistant Examiner*—Mark A. Deuble
(74) *Attorney, Agent, or Firm*—Fitzpatrick, Cella, Harper & Scinto

(57) ABSTRACT

An image forming apparatus includes discharging bins in which image-formed sheets are stacked, and uses a bin elevating motor to switch discharging of sheets into a selected discharging bin. The image forming apparatus is provided with a sensor for detecting the amount of stacked paper in the selected discharging bin. When the selected discharging bin is changed to a newly selected discharging bin, the discharging bins are moved by the bin elevating motor, whereby the sensor detects the amount of stacked paper in the newly selected discharging bin to which discharging can be performed after the moving. Subsequently, the sensor directs the start of image formation.

23 Claims, 13 Drawing Sheets

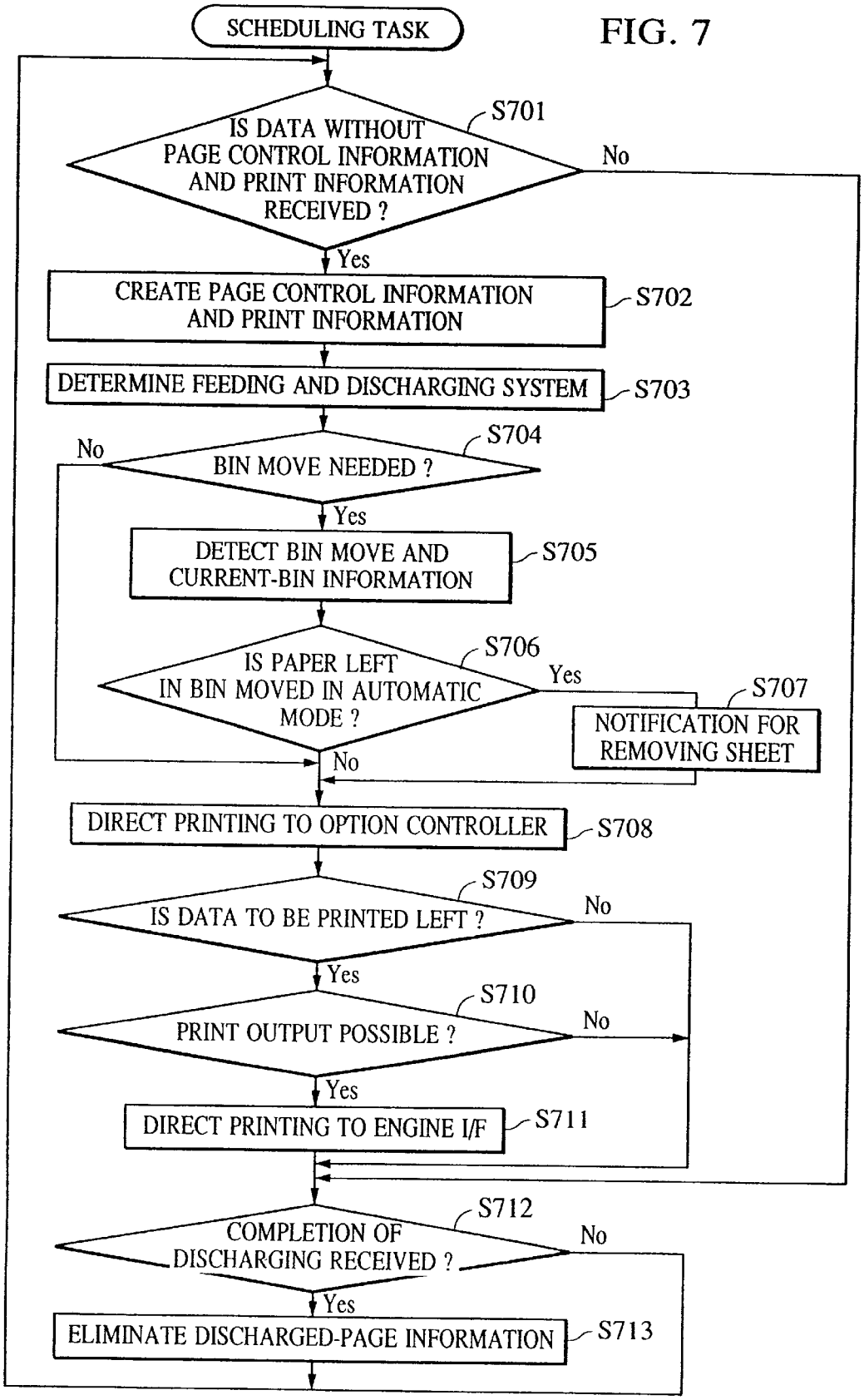
SCHEDULING TASK
FIG. 7
S701
IS DATA WITHOUT PAGE CONTROL INFORMATION AND PRINT INFORMATION RECEIVED ?
No
Yes
CREATE PAGE CONTROL INFORMATION AND PRINT INFORMATION
S702
DETERMINE FEEDING AND DISCHARGING SYSTEM
S703
S704
No
BIN MOVE NEEDED ?
Yes
DETECT BIN MOVE AND CURRENT-BIN INFORMATION
S705
S706
IS PAPER LEFT IN BIN MOVED IN AUTOMATIC MODE ?
Yes
S707
NOTIFICATION FOR REMOVING SHEET
No
DIRECT PRINTING TO OPTION CONTROLLER
S708
S709
IS DATA TO BE PRINTED LEFT ?
No
Yes
S710
PRINT OUTPUT POSSIBLE ?
No
Yes
DIRECT PRINTING TO ENGINE I/F
S711
S712
COMPLETION OF DISCHARGING RECEIVED ?
No
Yes
ELIMINATE DISCHARGED-PAGE INFORMATION
S713

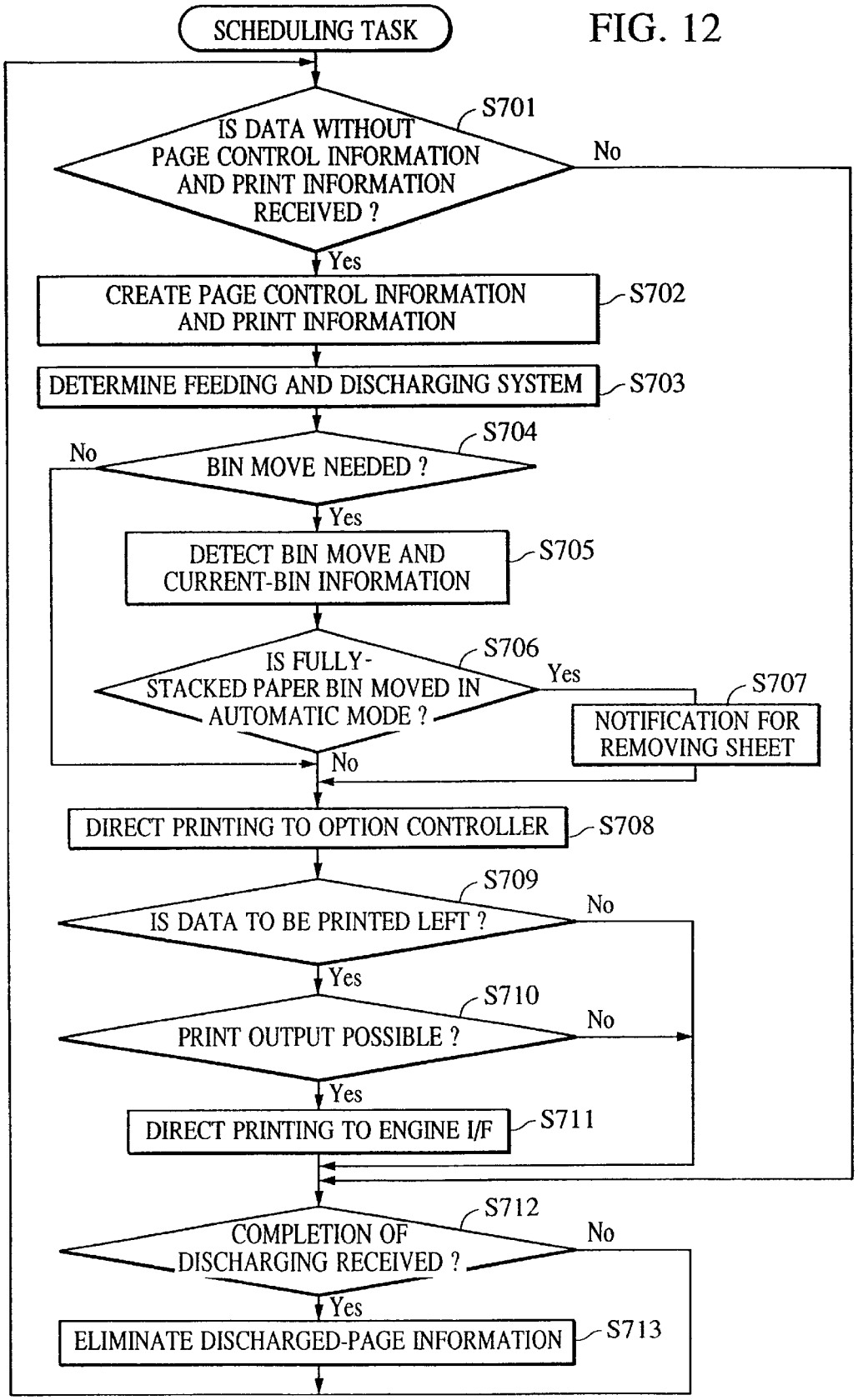
SCHEDULING TASK
FIG. 12
S701
IS DATA WITHOUT PAGE CONTROL INFORMATION AND PRINT INFORMATION RECEIVED ?
No
Yes
CREATE PAGE CONTROL INFORMATION AND PRINT INFORMATION
S702
DETERMINE FEEDING AND DISCHARGING SYSTEM
S703
S704
No
BIN MOVE NEEDED ?
Yes
DETECT BIN MOVE AND CURRENT-BIN INFORMATION
S705
S706
IS FULLY-STACKED PAPER BIN MOVED IN AUTOMATIC MODE ?
Yes
S707
NOTIFICATION FOR REMOVING SHEET
No
DIRECT PRINTING TO OPTION CONTROLLER
S708
S709
IS DATA TO BE PRINTED LEFT ?
No
Yes
S710
PRINT OUTPUT POSSIBLE ?
No
Yes
DIRECT PRINTING TO ENGINE I/F
S711
S712
COMPLETION OF DISCHARGING RECEIVED ?
No
Yes
ELIMINATE DISCHARGED-PAGE INFORMATION
S713

IMAGE FORMING APPARATUS HAVING A PLURALITY OF SHEET STACKING MEANS

BACKGROUND OF THE INVENTION

1. Field of the Invention

The present invention relates to an image forming apparatus in which sheets are discharged into any one of a plurality of sheet stacking means.

2. Description of the Related Art

There has been proposed a discharging option for a printer in which movable discharging bins have only one sensor for detecting the amount of paper stacked in each discharging bin and the detection is performed by moving each discharging bin. In addition, a method of controlling a printer connected to the discharging option has been proposed. In this control method, a print instruction is received from a host computer and command analyzing is performed. The determination whether to start printing is based on previously-obtained discharging-bin information rather than on the present state of the discharging bin.

The above-described conventional examples have the following problems:

In the printer, only while actual feeding and discharging is being performed can the condition of the discharging bin in use be detected. If the discharging bin is already full when the print instruction is received, several sheets are still printed because the detection of the stacked-paper amount is performed during actual discharging. Accordingly, several sheets are discharged into the fully-stacked discharging bin before notification of the full stack is issued. In other words, if the discharging bin is changed by a discharging-bin selecting instruction transmitted as part of print data from the host computer, the stacked-paper amount in the selected discharging bin cannot be detected until the previous sheets are discharged by performing the next printing because a discharging bin into which the previous discharging was performed had been operational (in a condition capable of detecting the stacked-paper amount). Accordingly, the processing must be performed based on the previous information. In the case of a discharging system with one single sensor that can detect only the stacked-paper amount in the operational discharging bin, detection is impossible when a user removes paper from or puts paper in a discharging bin other than the operational discharging bin. The system cannot operate based on accurate information because only the stacked-paper amount in the operational discharging bin can be detected.

As described above, only after discharging is started can an accurate stacked-paper amount be detected. Thus, a discharging bin that is already full may be used as the selected discharging bin. Thus, sheets are discharged into the fully-stacked discharging bin, and paper jamming occurs in the discharging system, which often causes malfunctioning.

In the case where paper in the fully-stacked discharging bin, which is not operational, is removed by the user, a problem occurs in that the discharging system has determined that the bin is fully-stacked, and prohibits the discharging bin from being used despite the fact that paper can be practically stacked in the discharging bin.

In the case where the discharging system has two modes: an automatic discharging mode for discharging into an empty discharging bin, and a fixed discharging mode for discharging into one fixed discharging bin, the modes may be mixed when being used by a plurality of users in a network environment. If, in the automatic discharging mode, a user performs a job that needs discharging a large amount of paper, the paper may be discharged into a plurality of discharging bins. By way of example, in the case where a user A performs fixed outputting to a second discharging bin, and another user B uses the automatic discharging mode to perform a large-amount of outputting to a first discharging bin as a starting point, the output of user B is discharged into the second discharging bin after the first discharging bin is full. Thus, the output of user B is stacked on the output of user A. The output of user A is mixed in the output of user B. Therefore, user B, who does not know that the output of user A has been discharged into the second discharging bin, may mistakenly remove the output of user A.

SUMMARY OF THE INVENTION

Accordingly, it is an object of the present invention to provide an image forming apparatus in which the foregoing problems are solved.

To this end, according to an aspect of the present invention, the foregoing object has been achieved through provision of an image forming apparatus comprising: image forming means for forming images on sheets; a plurality of sheet stacking means in which the sheets are stacked; selector means for selecting one sheet stacking means; moving means for moving to a predetermined position the selected sheet stacking means; detection means for detecting the sheet-stacked condition of the selected sheet stacking means; and control means for performing control so that, when the selected sheet stacking means is changed to a newly selected sheet stacking means, the moving means moves the newly selected sheet stacking means to the predetermined portion, and after the detection means detects the sheet-stacked condition of the newly selected sheet stacking means, image formation by the image forming means is started.

According to another aspect of the present invention, the foregoing object has been achieved through provision of an image forming apparatus comprising: image forming means for forming images on sheets; a plurality of sheet stacking means for stacking the sheets; control means for activating a first mode in which the sheets are stacked by the sheet stacking means selected by an external unit, and a second mode in which the sheets are stacked by the sheet stacking means automatically selected by the image forming apparatus; and information means used such that, in the second mode, when the selected sheet stacking means is changed to a newly selected sheet stacking means, the information means gives information urging sheet removal depending on the sheet-stacked condition of the newly selected sheet stacking means.

According to a further aspect of the present invention, the foregoing object has been achieved through provision of a stacker comprising: stacking means for stacking sheets on which images are formed; discharging control means for performing either of face-down discharging and face-up discharging onto the stacking means; detection means for detecting the amount of the sheets stacked on the stacking means; and full-stack detecting means for detecting whether there is a full stack of the sheets on the stacking means by determining whether the detected amount of said sheets at least equals a first predetermined amount when face-down discharging is performed by the discharging control means, and a second predetermined amount, which is less than the first predetermined amount, when face-up discharging is performed by the discharging control means.

Other objects and features of the present invention will be apparent from the following description and the attached drawings.

BRIEF DESCRIPTION OF THE DRAWINGS

FIG. 7 is a flowchart showing a scheduling task.

FIG. 12 is a flowchart showing a scheduling task.

DESCRIPTION OF THE PREFERRED EMBODIMENTS

Figure 1:
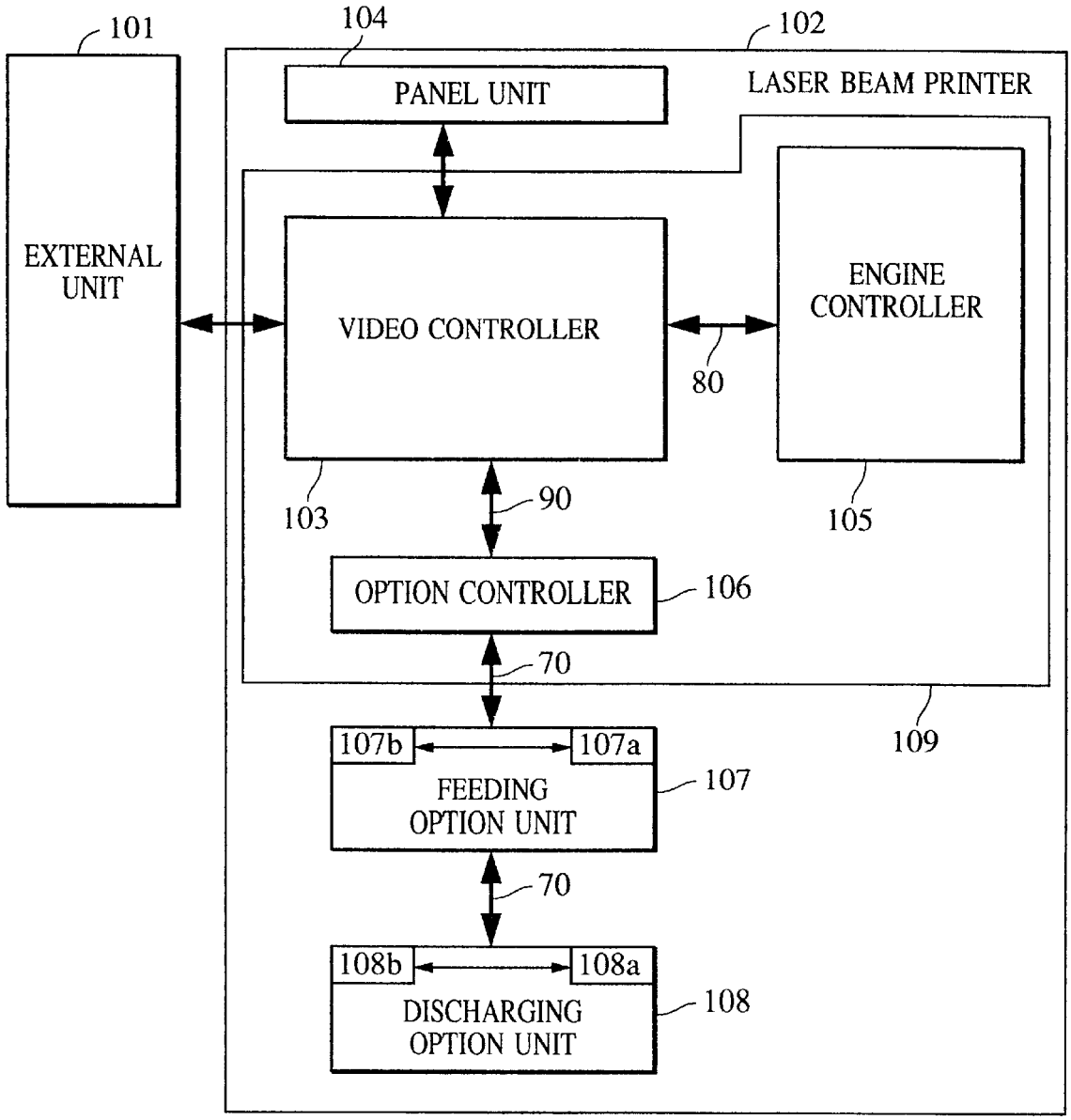
FIG. 1 is a block diagram illustrating an image forming apparatus.

FIG. 1 shows the structure of a system including a printer such as a laser beam printer. In this embodiment, the printer need not be a laser beam printer, but may be another type such as an ink-jet printer. One embodiment in which two option units are connected to the system is described below with reference to the attached drawings. However, more option units can be connected, and the system itself may have the function of each option unit.

In FIG. 1, a laser beam printer 102 can be connected to various option units such as a finisher and a paper deck. The printer 102 is connected to an external unit 101 by a general-purpose interface (e.g., Centronics, RS-232C, etc.). The laser beam printer 102 performs image recording based on print information (control information such as code data based on a predetermined printer language including, e.g., Postscript, LIPS III, LIPS IV, and image data) transferred from the external unit 101 via the general-purpose interface. A video controller 103 is connected to the external unit 101 by the general-purpose interface. The video controller 103 receives code data (ESC code, types of PDL data, etc.) transferred from the external unit 101 via the general-purpose interface, and generates page information composed of dot data, etc., based on the code data. The video controller 103 transmits (binary or multivalue) image data to an engine controller 105 (described below) via a video interface 80, and transmits a feeder selecting command, discharger selecting command, etc., to an option controller 106 (described below) via a total interface 90. The engine controller 105 uses a known photographic process to form a latent image on a photosensitive drum based on the image data transferred from the video controller 103, and performs printing by transferring the latent image to and fixing it on a supplied sheet of paper. At this time, the engine controller 105 uses the video controller 103 to notify the option controller 106 of the correct timing for paper feeding and discharging.

A panel unit 104 consists of various switches (buttons) for operations, light-emitting-diode indicators, and liquid-crystal display devices. The panel unit 104 serves as a user interface. The user can command the printer 102 to perform a predetermined operation by operating the panel unit 104. Various data, etc., set by the user are stored and managed in non-volatile memories (such as an NVRAM and an EEPROM) in a control unit 109. The option controller 106 is a total controller that includes a CPU, a ROM and a RAM (not shown) and that completely controls at least one option unit based on an instruction for feeding and discharging paper transferred from the video controller 103 and an instruction for the timing of paper feeding and discharging transferred from the engine controller 105. The option controller 106 communicates with an option controller unit provided for each option unit via an option-unit interface 70, thereby attaining total control over each option unit.

Figure 5:
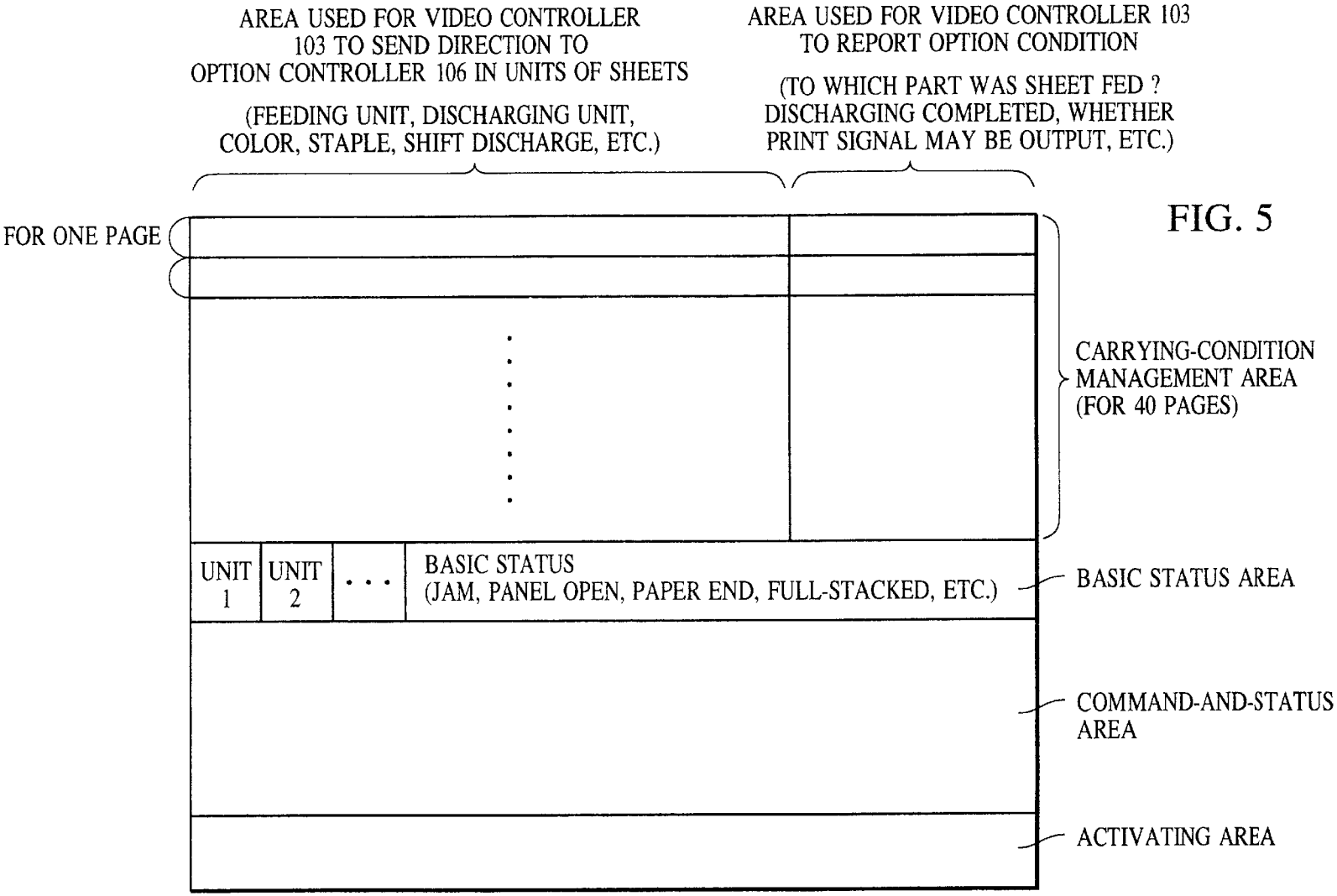
FIG. 5 is a schematic diagram showing a shared memory for the video controller 103 and the option controller 106 shown in FIG. 1, which is reserved in a random access memory provided in the option controller 106.

The RAM of the option controller 106 includes a shared memory that can be accessed by the video controller 103. As shown in FIG. 5, the shared memory includes a carrying-condition management area for 40 pages, a basic status area, a command-and-status management area, and an activation processing area. The video controller 103 directs each option unit via each area in the shared memory.

The carrying-condition management area consists of a region for notifying each option unit of instructions (feeder, discharger, color, stapling, shift discharging, etc.) in units of sheets of paper, and a region for notifying the video controller 103 of each option condition (to what extent printing has been performed, discharging completed, etc.). The basic status area is a region for notifying the video controller 103 of abnormal conditions (paper jam, paperless stapling, no staples, etc.) in each option unit. The command-and-status management area is a region for an exchange of commands and statuses with the video controller 103. The activation processing area is a region for instructing by the video controller 103, activation processing for each option unit.

A feeding option unit 107 (shown in FIG. 1) is, for example, a paper-deck option unit, and includes a paper-deck controller (large-capacity feeding controller) 107*a*, whereby paper feeding is controlled based on control information transmitted from the option controller 106. The paper-deck controller 107*a* includes a CPU, a ROM, and a RAM (not shown), and the CPU controls the feeding option unit 107 based on programs stored in the ROM. In the ROM, extension information as to the feeding option unit 107, for example, information as to paper sizes capable of being accommodated in the paper deck is stored.

A paper-discharging option unit 108 is, for example, a finisher option unit having a stapling function. The paper-discharging option unit 108 includes a finisher controller (large-capacity paper-discharging stacker controller) 108*a*, whereby stapling and discharging is performed based on control information transmitted from the option controller 106. The finisher controller 108*a* includes a CPU, a ROM, and a RAM (not shown), and the CPU controls the paper-discharging option unit 108 based on a program stored in the ROM. In the ROM, extension information as to the paper-discharging option unit 108 are stored, such as the number of discharging bins, whether a stapling function is provided, whether a shift function for shifting discharged paper in a predetermined direction is provided, and whether an inverting function for inverting the face direction of discharged paper is provided.

The feeding option unit (paper deck) 107 and the paper-discharging option unit (finisher) 108 are respectively provided with operation units 107*b* and 108*b* having a display unit and various keys, whereby, when each unit 107 or 108 is used, a message, an operation method, etc., can be displayed for the user, and the user can operate each unit 107 or 108.

The control unit 109 includes the engine controller 105 which controls the print process in the printer 102, the video controller 103 which controls the total performance of the printer 102 and analyzes and converts data from the external unit 101, such as a host computer, into image data, and the option controller 106 which controls the total performance of the option units 107 and 108.

The option controller 106 uses the common option-unit interface 70 to manage the option units 107 and 108, and uses the total interface 90 to communicate with the video controller 103. In this embodiment, the option units 107 and 108 are controlled via the option controller 106 by the video controller 103.

Figure 2:
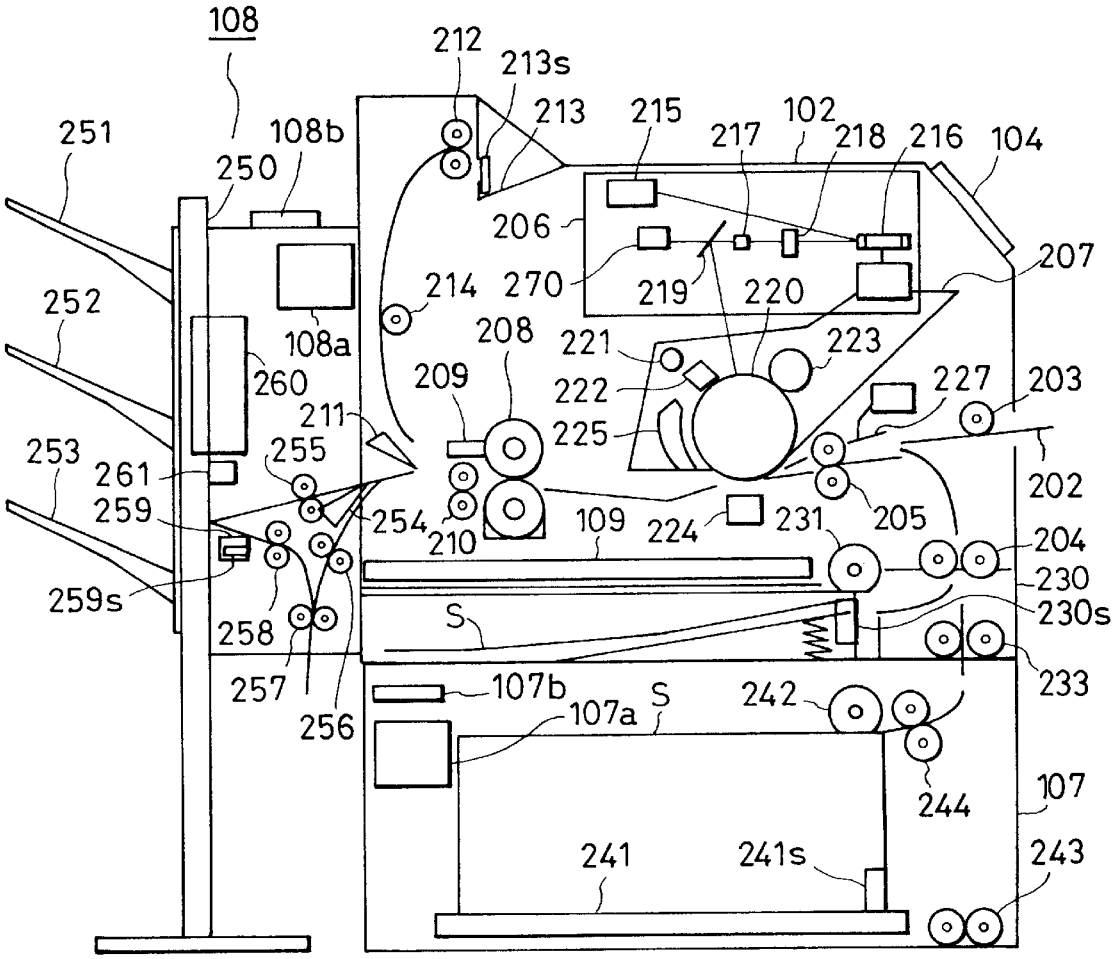
FIG. 2 is a schematic section view illustrating an image recording system composed of an image forming apparatus and its option units.

FIG. 2 is a sectional view illustrating the structure of the laser beam printer 102 shown in FIG. 1, in which components identical to those shown in FIG. 1 are denoted by the same reference numerals. Referring to FIG. 2, a paper cassette 230 holds recording paper S, and has a mechanism for using the position of a partition to detect the size of recording paper S. A cassette feeding clutch 231 is a cam that separates only the top sheet of the recording paper S loaded in the paper cassette 230 and carries the separated recording paper sheet S to a feeding roller 204. The cassette feeding clutch 231 intermittently rotates whenever feeding is performed. One sheet of the recording paper S is fed for every one rotation of the cassette feeding clutch 231. A recording-paper detecting sensor 230S detects the amount of the recording paper S in the paper cassette 230.

A resist shutter 227 presses the recording paper S to stop paper feeding. A feeding roller 204 carries the top portion of the sheet of the recording paper S to the resist shutter 227. Recording paper S is disposed on a manual-feeding tray 202. A manual feeding clutch 203 carries the recording paper S disposed on the manual feeding tray 202 to the resist shutter 227. An option feeding roller (feeding relay roller) 233 supplies to the inside of the printer 102 the recording paper S fed from the feeding option unit 107.

A pair of resist rollers 205 that perform the synchronized carrying of the recording paper S are provided after the manual feeding clutch 203, the cassette feeding clutch 231, and the option feeding roller 233. An image recording unit 207 that uses a laser beam emitted from a laser scanner unit 206 to form a toner image on one sheet of the recording paper S by using a known electrographic process is provided above the pair of resist rollers 205.

In the laser scanner unit 206, a laser unit 215 emits a laser beam based on an image signal (VDO signal) sent from the video controller 103. A polygon mirror 216 causes the laser beam emitted from the laser unit 215 to scan a photosensitive drum 220 via an imaging lens unit 218 and a turn mirror 219, whereby a latent image is formed on the photosensitive drum 220. A beam detector 217 detects the laser beam emitted from the laser unit 215 before outputting a main-scanning synchronizing signal. A luminosity sensor 270 detects the luminosity amount of the laser beam emitted from the laser unit 215.

In the image recording unit 207, a primary charger 222 uniformly charges the photosensitive drum 220. A developer 223 is charged by the primary charger 222, whereby the latent image formed on the photosensitive drum 220 as a result of laser exposure by the laser scanner unit 206 is developed with toner. A transfer charger 224 transfers the toner image developed by the developer 223 onto the sheet of recording paper S fed by the resist roller 205. A cleaner 225 removes the remaining toner. A pre-exposure lamp 221 discharges the photosensitive drum 220 with its light.

A fixer 208 uses heat to fix on the sheet of recording paper. S the toner image formed by the image recording unit 207. A carrier roller 210 discharges the sheet of recording paper S. A discharging sensor 209 detects the condition of discharging. A flapper 211 directs the sheet of recording paper S on which recording is complete to the discharging tray 213 or the paper-discharging option unit 108. Discharging rollers 214 and 212 discharge the sheet of recording paper S onto a stacker tray 213. A discharged-paper-amount detecting sensor 213s detects the amount of the recording paper S stacked on the stacker tray.

The engine controller 105 in the control unit 109 controls the electrographic process carried out by the laser scanner 206, the image recording unit 207 and the fixer 208, and controls the carrying of the recording paper S through the laser beam printer 102.

The video controller 103 is connected to the external unit, such as a personal computer, by the general-purpose interface (e.g., Centronics, RS-232C, etc.). The video controller 103 expands image information sent via the general-purpose interface into bit data, and sends the bit data as a VDO signal to the engine controller 105 via the video interface 80.

Next, each option unit removably connected to the laser beam printer 102 will be described. The option controller 106 (shown in FIG. 1) is provided in the laser beam printer 102, and can perform communication using the same protocol via the option-unit interface 70 as a common bus for each option unit. The option controller 106 is connected to the video controller 103 via the total interface 90.

In the feeding option unit 107, here shown as a paper-deck option unit, a large amount of the recording paper S is stored on a paper deck 241, which functions as an elevator. A paper-deck feeding roller 242 feeds the recording paper S. Carrier rollers 244 carry the recording paper S fed by the paper deck feeding roller 242 toward option feeding rollers 233. Feeding relay rollers 243 relay the recording paper S fed from other feeding option units (capable of feeding the recording paper S having a different size or the same size) that can be removably connected to the bottom of the feeding option 107. The paper deck 241 also detects the amount of the stacked recording paper S. The paper-deck option unit 107 is controlled by the paper-deck controller 107*a*.

In the discharging option unit 108, here shown as a finisher option unit, recorded sheets of the recording paper S are separately stacked by a first discharging bin 251, a second discharging bin 252, and a third discharging bin 253. A bin lifting motor 260 vertically moves the discharging bins 251 to 253 to change the selected discharging bin. Before being sent to the finisher option unit 108, carrying of the recording paper S can be switched so that sheet face switching (either face-up or face-down) can be performed based on an instruction from the video controller 103.

A discharged-paper-amount detecting sensor 261 detects the amount of the recording paper S discharged into the selected discharging bin. The discharged-paper-amount detecting sensor 261 is a height sensor that detects the height of the recording paper S stacked on the discharging bin by optically detecting the distance between it and the top sheet of the recording paper S. When the height of the recording paper S, stacked on one of the first discharging bin 251 to the third discharging bin 253, reaches a predetermined amount, the finisher controller 108*a* uses the option controller 106 to notify the video controller 103 of the fully stacked condition. The predetermined amount for fully stacked condition in the face-down discharging mode is set at 88 mm (corresponding to approximately 700 sheets), and the predetermined amount for a fully stacked condition in the face-up discharging mode is set at 44 mm. This is because face-down discharged sheets are limited to sheets having preferable stackability, while face-up discharged sheets may be sheets having inferior stackability, such as envelopes, cardboard, and overhead-projector sheets. The reason why envelopes, cardboard, and overhead-projector sheets are not discharged face-down is because such types of sheets may become jammed when being switched back since switching back, is required for the above-described face-down discharging. In addition, in a mode where stapled sheets are stacked, the predetermined amount for a fully stacked condition is set at 44 mm. In this embodiment, the amount of stacked sheets is detected by height. However, by counting the number of discharged sheets, the above-described control may also be performed. In this case, the predetermined amount for a fully stacked condition in the face-down discharging mode is set at 700 sheets, and the predetermined amount for a fully stacked condition in the face-up discharging mode or the stapling mode is set at 350 sheets.

When face-up discharging is commanded through the total interface 90 by the video controller 103, the sheet of recording paper S, distributed by a flapper 254, is carried to the discharging bin 251, 252 or 253. When face-down discharging is commanded through the total interface 90 by 20 the video controller 103, the sheet of recording paper S, distributed by the flapper 254, is carried by rollers 256 and 257 until the end of the sheet passes over the rollers 256, at which time the rollers 257 inversely rotate to carry the end of the sheet to rollers 258, and further to the discharging bin 251, 252 or 253.

When stapling is commanded through the total interface 90 by the video controller 103, a stapler 259 executes stapling before discharging the sheet of recording paper S to any one of the first discharging bin 251 to the third discharging bin 253. When shifting is commanded through the total interface 90 by the video controller 103, the first discharging bin 251 to the third discharging bin 253 are shifted, and the sheet of recording paper S is discharged into any one of the first discharging bin 251 to the third discharging bin 253. This shifts the stack region for the discharged sheet of recording paper S. A residual staple detecting sensor 259S detects the residual amount of staples in the stapler 259. The finisher option unit 108 is controlled by the finisher controller 108*a*.

The option controller 106, the paper-deck controller 107*a*, and the finisher controller 108*a* are connected by connectors, and use the option-unit interfaces 70 to perform serial communication. They are connected in series by the same connectors. Accordingly, the paper-deck controller 107*a*, and the finisher controller 108*a* can be permuted.

The pair of resist rollers 205, the feeding rollers 204, and the carrier rollers 244 are provided after the manual feeding roller 203, the cassette feeding clutch 231, and the paper deck feeding roller 242, respectively. The image recording unit 207 that uses the laser beam emitted from the laser scanner unit 206 to form a toner image on a sheet of recording paper S is provided after the resist rollers 205. The fixer 208 that uses heat to fix the toner image formed on the sheet of recording paper S is provided after the image recording unit 207. The discharging sensor 209 for detecting the condition of carrying by the discharging unit, and the carrier rollers 210, and the flapper 211 for carrying the sheet of recording paper S are provided after the fixer 208.

Figure 3:
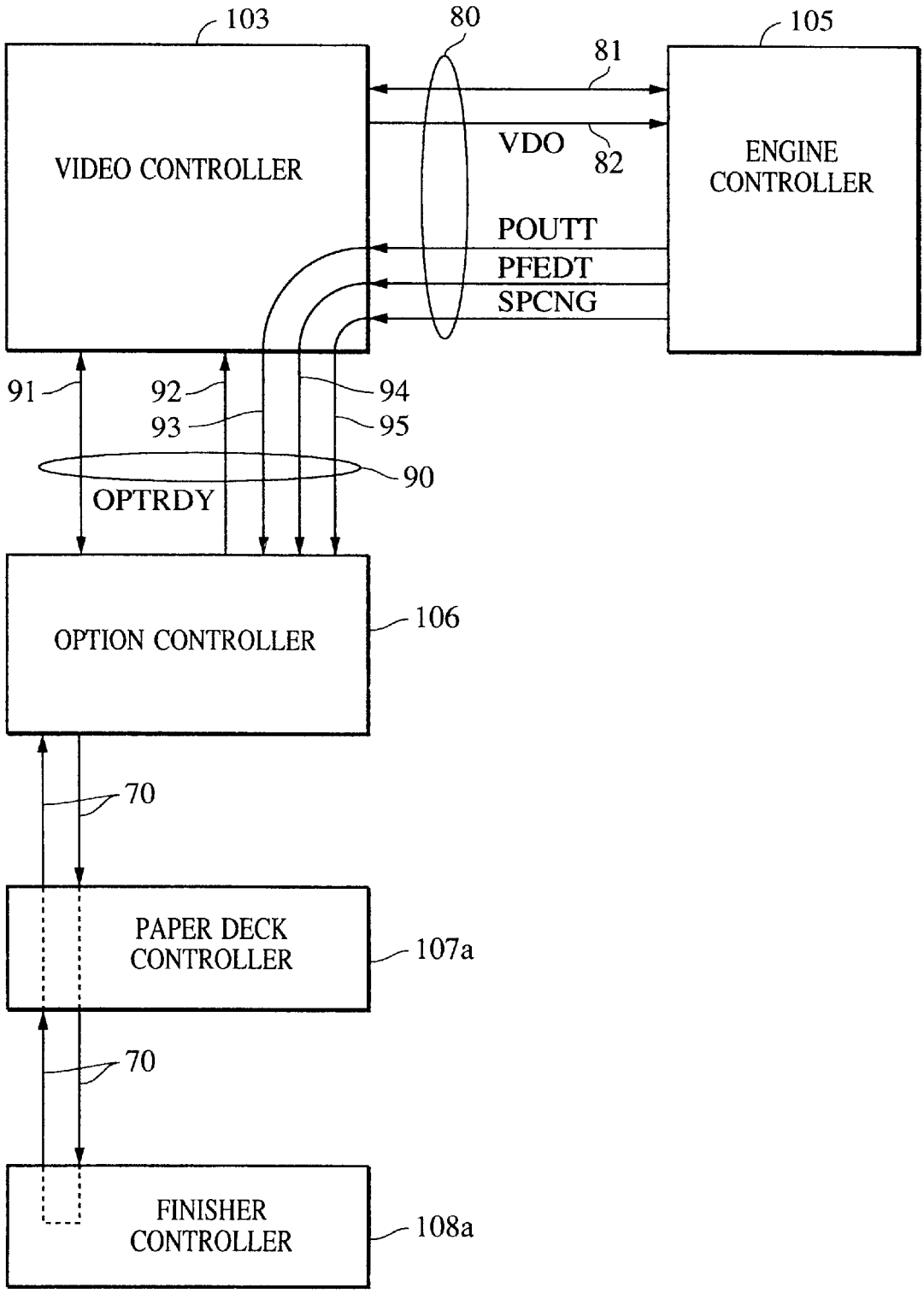
FIG. 3 is a block diagram illustrating interfaces for the controllers in the image recording system shown in FIG. 2.

FIG. 3 shows a block diagram of the laser beam printer 102 shown in FIG. 1, and components identical to those shown in FIG. 1 are denoted by the same reference numerals. Commands, such as a feeding instruction to the paper deck option unit 107 and a discharging bin instruction to the finisher option unit 108, are transmitted from the video controller 103 to the option controller 106 via a serial communication interface 91. Statuses, such as whether the paper deck option unit 107 has the recording paper S, how many sheets of recording paper S are stacked on each discharging bin of the finisher option unit 108, and whether staples are left, are transmitted from the option controller 106 to the video controller 103 via the serial communication interface 91. The option controller 106 and the video controller 103 may be directly connected by a CPU bus.

An option ready signal (OPTRDY) signal 92 represents whether or not an option specified by the video controller 103, for example, stapling, can be used. The OPTRDY signal 92 is transmitted from the option controller 106 to the video controller 103. A paper-out timing (POUTT) signal 93 functions as a timing signal used when the laser beam printer 102 discharges the recording paper S. A paper-feed timing (PFEDT) signal 94 functions as a timing signal used when the laser beam printer 102 receives the recording paper S from the paper deck option unit 107. A speed change signal (SPCNG) signal 95 functions as a signal for reducing the speed of the sheet of recording paper S rapidly carried into the paper deck option unit 107 so as to be matched with the carrying speed used by the laser beam printer 102.

Commands, such as a feeding instruction to the feeding cassette in the laser beam printer 102, a discharging instruction to the discharging tray 213, and a print instruction, are sent from the video controller 103 to the engine controller 105 via a communication interface 81. Statuses, such as whether the paper cassette 230 in the laser beam printer 102 has the recording paper S, and paper jam, are sent from the engine controller 105 to the video controller 103. A VDO signal 82 represents bit data transmitted from the video controller 103.

The total interface 90 consists of five hardware signals: the serial communication interface 91; the OPTRDY signal 92, the POUTT signal 93, the PFEDT signal 94 and the PCNG signal 95. The POUTT signal 93, the PFEDT signal 94, and the PCNG signal 95 are output from the engine controller 105, and are input to the option controller 106 via the video interface 80 and the video controller 103.

Figure 4:
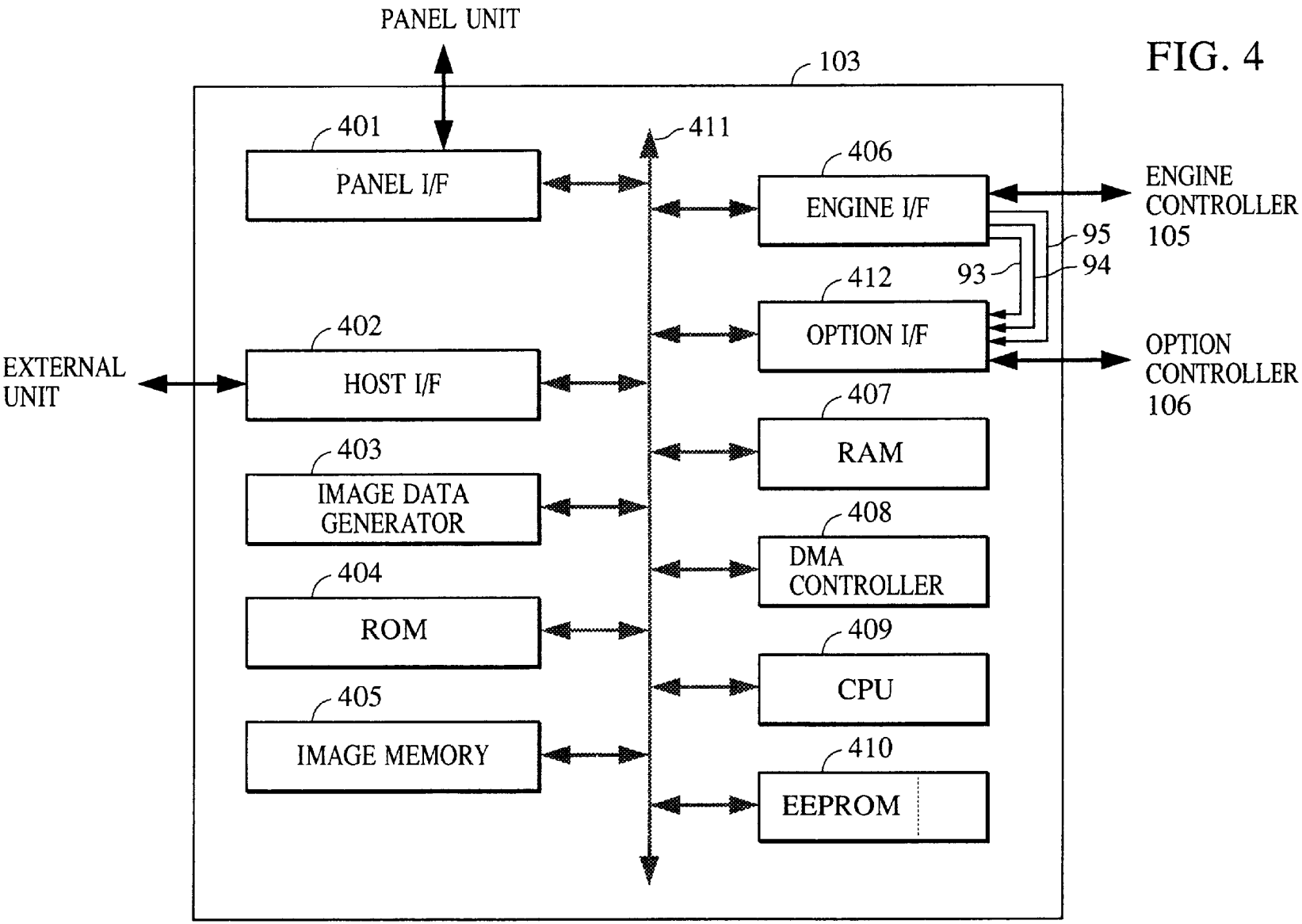
FIG. 4 is a block diagram illustrating details of the video controller shown in FIG. 1.

FIG. 4 is a block diagram illustrating the structure of the video controller 103 shown in FIG. 1. Components identical to those shown in FIG. 1 are denoted by the same reference numerals. A panel interface (I/F) 401 receives various settings and instructions by an operator from the panel unit 104 by performing data communication with the panel unit 104. A host interface (I/F) 402 is a signal input/output unit for communication with the external unit such as a host computer. An engine interface (I/F) 406 is a signal input/output unit for communication with the engine controller 105. The engine I/F 406 sends a data signal from its output buffer register (not shown), and controls communication with the engine controller 105.

An image data generator 403 generates bitmap data for actual printing based on control code data sent from the external unit 101. An image memory 405 stores image data. A CPU 409 controls the total function of the video controller 103. A ROM 404 stores control codes for the CPU 409. A RAM 407 functions as a temporary memory means used by the CPU 409. An electrically erasable programmable read-only memory (EEPROM) 410 is composed of a non-volatile memory medium. A DMA controller 408 transfers bitmap data stored in the image memory to the engine interface 406 in accordance with an instruction from the CPU 409. An option interface (I/F) 412 communicates with the option controller 106 in accordance with an instruction from the CPU 409. The POUTT signal 93, the PFEDT signal 94, and the PCNG signal 95 are directly sent from the engine I/F 406 to the total interface 90.

A system bus 411 has an address bus and a data bus. The panel I/F 401, the host I/F 402, the image data generator 403, the ROM 404, the image memory 405, the engine I/F 406, the RAM 407, the DMA controller 408, the CPU 409, the EEPROM 410, and the option I/F 412 are connected to the system bus 411, and can access all function units on the system bus 411.

A control code for controlling the CPU 409 is composed of an operating system using system clocks (not shown) to perform time-sharing control in units of loaded modules called "tasks", and loaded modules (shown below) operating in units of functions.

FIG. 5 is a schematic diagram showing a shared memory with the video controller 103, which is reserved in a RAM provided in the option controller 106. FIGS. 11A and 11B are schematic charts showing procedures in which a command status is issued based on a basic status to obtain detailed information on each option unit. FIGS. 6, 7, 8, 9, and 10 are flowcharts illustrating this embodiment.

A control method in which the video controller 103 uses the option controller 106 to perform total control of each option unit is described with reference to FIGS. 5, 11A and 11B. The shared memory, shown in FIG. 5, is composed of a carrying-condition management area for issuing an instruction on a page and knowing the sheet carrying condition, a basic status area for knowing abnormal conditions of each option unit, a command-and-status management area for exchanging command statuses, and an activating area for instructing the activation of each option unit.

The activating area is composed of an instruction part for sending an instruction from the video controller 103 and a completion notification part for reporting completion of processing by each option unit as a result of sending the instruction. The video controller 103 stores an instruction in the activating area to activate each option. When the main power is supplied, the video controller 103 notifies the activating area of an instruction for acquiring configuration information about each option unit, completion of information acquisition, etc. The completion notification part is monitored to determine whether each processing is completed. The activation is terminated by recognizing the completion.

The carrying-condition management area is composed of an area for instructing printing conditions such as the feeding unit, the discharging unit, color/monochrome, stapling position, and executing, and an area used for the video controller 103 to report option condition. The video controller 103 specifies the printing conditions to execute printing, while knowing each option condition.

The above-described instructing can be performed for a maximum of 40 pages. The instructing is sequentially performed for each page. A region used for a page completely discharged is regarded as a space, and is initialized so as to be reused in the manner of a ring buffer.

The basic status area reports abnormal conditions of each option unit. From the basic status area, conditions, such as paper end, paper jam, panel open, and full stack, are acquired. From the contents of the basic status, more detailed information is acquired based on the command-and-status.

The command-and-status management area is for controlling the detailed information acquisition and operation of each option unit. By specifying a necessary command in this area, information is acquired. Information that can be acquired is, for example, a unit name, the size of a paper sheet to be fed, the amount of paper sheets left, the position of a paper jam, a type, an access point, the amount of discharged sheets of paper stacked, details of malfunction, and so forth. These particulars cause corresponding commands to be issued, and statuses are received in response. In addition, option controls, such as transfer to a power-saving mode, emergency stop at paper jam, a discharging bin move, and resetting, are performed using the command-and-status area.

As described above, the video controller 103 acquires the information. When no abnormal condition is detected, the video controller 103 executes printing. When an abnormal condition is detected from the basic status, the video controller 103 issues a command status for specifying an abnormal part and further specifying an abnormal particular for the unit. The video controller 103 then performs detailed information collecting and control in accordance with the abnormal condition.

Figure 6:
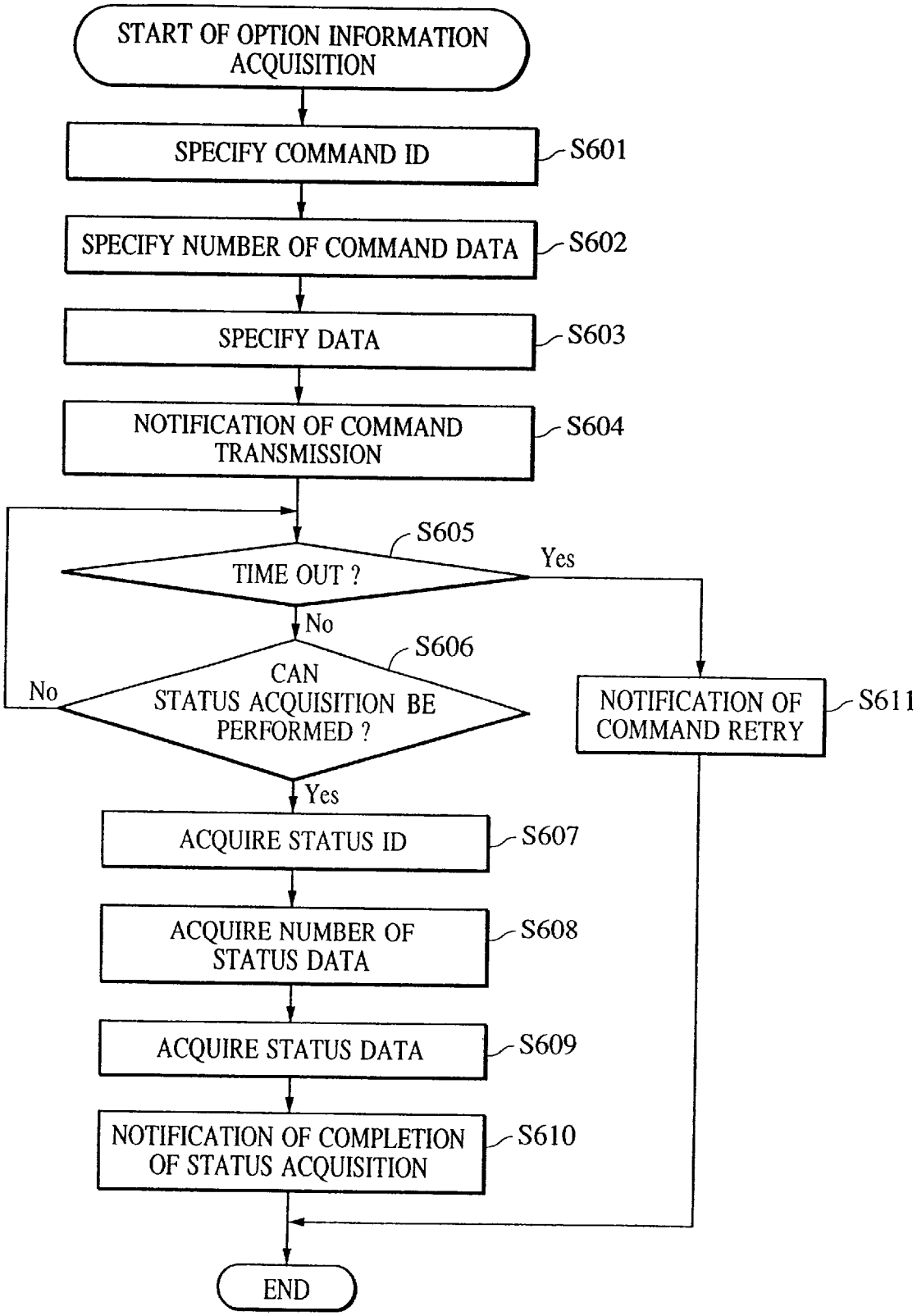
FIG. 6 is a flowchart showing one example of a process for obtaining option information via an option controller.

FIG. 6 is a flowchart of processing in which the video controller 103 accesses the shared memory in the option controller 106 and issues command statuses with respect to each option unit for information exchange.

To acquire option information, the video controller 103 accesses the command-and-status area in the memory of the option controller 106, and receives the information. The video controller 103 specifies at predetermined addresses in the specified command region a command ID by which the type of necessary information can be identified (step S601), the number of command data for using execution commands to direct the option controller 106 (step S602), and data representing specified contents (step S603). The video controller 103 notifies the option controller 106 of its having transmitted these commands, thereby triggering the acquisition of information from each option unit (step S604). Once triggered, the option controller 106 obtains the specified information by performing serial communication with a specified option unit. Meanwhile, a timer is activated until the option controller 106 completely obtains the information, and the process monitors whether the video controller 103 is in a condition capable of acquiring the status information (steps S605 and S606). In the case where the video controller 103 is not in a condition capable of acquiring the status information, after a fixed amount of time passes, notification for re-executing the command is given (step S611) before the process ends. If, in step S606, the video controller 103 is in a condition capable of acquiring the status information, the status ID is obtained to verify whether the status information corresponds to the specified command (step S607). Next, after obtaining the number of status data (step S608), status data for the number of status data are obtained (step S609), and the option controller 106 is notified of completion of the status acquisition (step S610).

FIG. 7 is a flowchart of a scheduling task using command information analyzed and converted by a translating task to perform scheduling based on the control data and print data sent from the host computer 101. This scheduling task is executed by the video controller 103. In S701, the scheduling task monitors whether it receives data from which page control information and print information (sent from the host computer 101) should be created. When the scheduling task in the video controller 103 receives the print data from which page control information and print information should be created, it creates page control information and print information based on the contents specified by a layout command (step S702). Based on the page information created in step S702, a feeding-and-discharging system is determined (step S703). The reason why steps S702 and S703 are separately provided is that, in step S702, the instruction includes discharging-bin automatic selection, and in this step, a final feeding-and-discharging system cannot be determined. In other words, step S702 differs from step S703 in that a fixed feeding-and-discharging system is determined based on information such as paper end and paper size for feeding, and whether stacking can be performed for discharging.

Next, in accordance with the feeding-and-discharging system determined in step S703, the scheduling task determines whether bin moving is needed. In the case where bin moving is needed, the scheduling task issues a bin moving command to the option controller 106 so that a discharging bin to which discharging to be performed is operational, and the scheduling task detects paper-stacking information for the operation bin (step S705). As a result of detecting the operational-bin paper-stacking information, when, in the discharging-bin automatic-selection mode, the discharged paper is stacked in the operational bin (step S706), a message such as "Remove paper"is displayed on the panel unit 104. Meanwhile, the host computer 101 is notified of the status, whereby the user is urged to remove the discharged paper (step S707), and paper removal is awaited. If, in step S706, the discharging-bin automatic-selection mode is not set, in other words, the fixed-bin-selection mode is set, or the discharged paper is not stacked, the scheduling task proceeds to step S708. In accordance with the discharging-bin automatic-selection mode, first discharging into the bin specified by the external unit 101 or a predetermined bin is performed, then the bin is automatically switched to another bin when full. The fixed-bin-selection mode is such that fixed discharging into only the bin specified by the external unit 101 is performed.

The reason why step S707 is executed is as follows: assuming that, when a print job in the discharging-bin automatic-selection mode is instructed, with paper from another job left in the second bin, discharging into the first to third bins has been performed because of a large number of print pages, a problem occurs in which all the paper in the first to third bins are removed by a user having instructed the print job in the discharging-bin automatic-selection mode, and the included other-job paper is removed by the different user. Conversely, in the fixed-bin-selection mode, a user removes a user's-job paper in a selected bin on condition that various users can select arbitrary bins. If other-job paper is in the selected bin, paper is discharged into the selected bin. When discharging can be performed, the scheduling task specifies printing in the shared memory (shown in FIG. 5) of the option controller 106 via the option I/F task (step S708).

In step S709, the scheduling task determines whether there is a page on which printing has not been performed. If there is a page, the scheduling task determines whether the engine controller 105 is ready and is in a condition capable of sending print output (step S710). The scheduling task directs an engine I/F task (shown in FIG. 8 described below) to perform printing (step S711), and the engine I/F task directs the engine controller 105 to perform printing, whereby printing is started. In steps S709 and S710, if there is no data to be printed and the engine controller 105 is not in a condition capable of sending print output, the scheduling task does not direct the engine I/F task, and the process proceeds to step S712.

In step S712, the scheduling task monitors whether completion of discharging has been received. If the completion of discharging has been received, the scheduling task updates the condition of the specified page so that the completed page information is eliminated to increase memory capacity before the process returns to the receiving determination in step S701. In the case where, after print data for only one page is specified, print data for which scheduling should be performed is not sent, step S712 is performed repeatedly, whereby the scheduling task only updates the specified page. In the case where continuous printing is performed by receiving print data for a plurality of pages, in order to improve the throughput, the scheduling task directs the engine controller 105 to perform printing while ordinarily instructing the option controller 106 to perform printing two or three pages ahead, whereby steps S702 to S708 are repeatedly executed before processing by the engine I/F task starts.

Although step S706 is branched depending on whether the discharged paper is stacked on the selected discharging bin in the discharging-bin automatic-selection mode (in step S720 as shown in FIG. 12), the scheduling task may proceed to step S707 when the moved discharging bin is full, or may proceed to step S708 when the moved discharging bin is not full.

Figure 8:
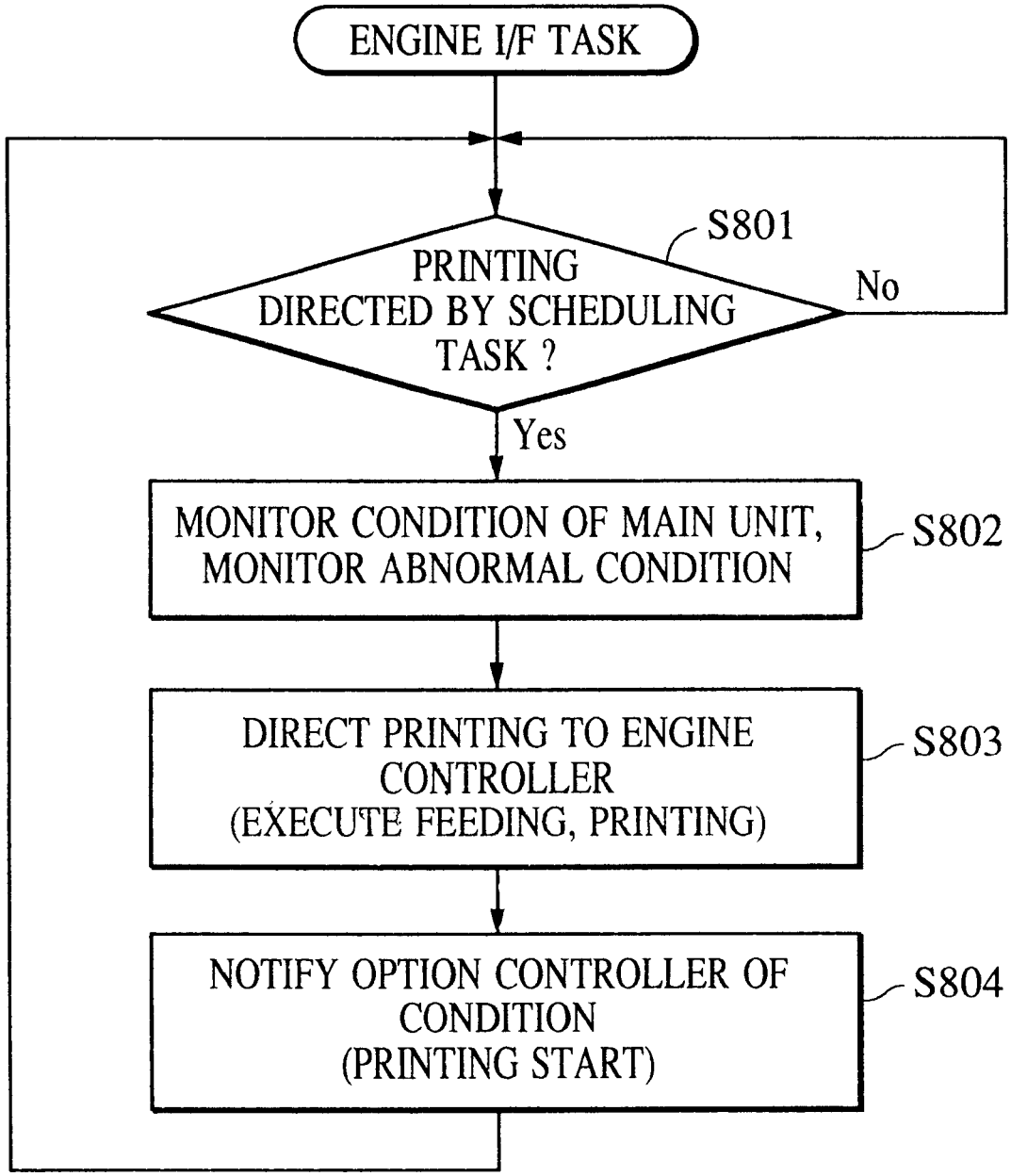
FIG. 8 is a flowchart showing an engine interface (I/F) task.

FIG. 8 is a flowchart illustrating an engine I/F task for executing printing based on page information created by the scheduling tasks shown in FIGS. 7 and 12. The engine I/F task is executed by the video controller 103. The engine I/F task is activated by the print instruction from the scheduling task. The engine I/F task determines whether the scheduling task directs it to perform printing (step S801). If the engine I/F task has determined that the scheduling task directs it to perform printing, it monitors the laser beam printer 102 as to conditions (printing executable, paper size, etc.) and abnormal conditions (paper end, panel open, paper jam, etc.) (Step S802), and notifies a necessary task. The engine I/F task uses the engine I/F 406 to direct the engine controller 105 to perform printing, whereby printing is executed (step S803). The engine I/F task uses the option I/F 412 to notify the option controller 106 of a feeding start, a printing start, etc. (step S804), before returning to step S801.

Figure 9:
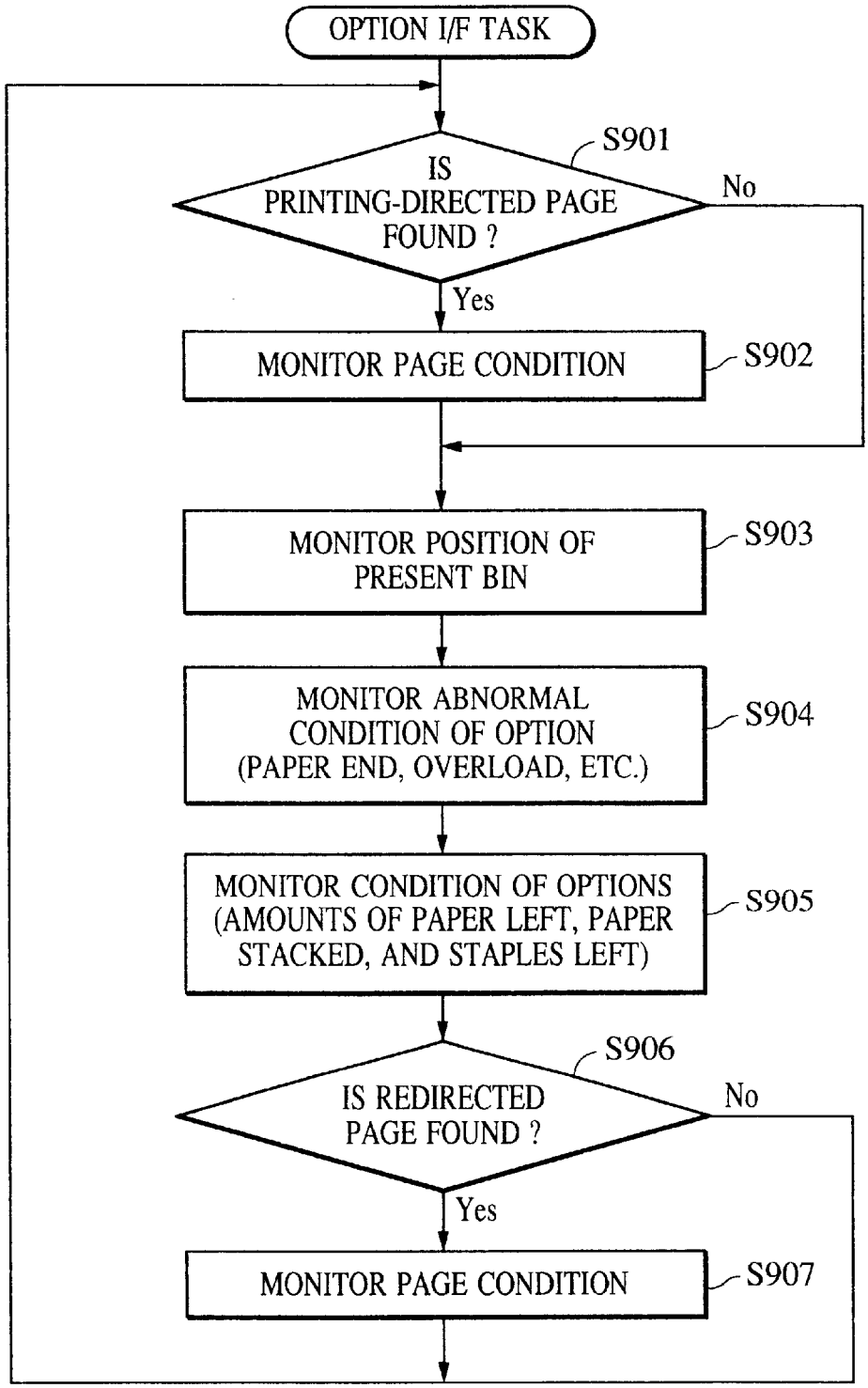
FIG. 9 is a flowchart showing an option I/F task.

FIG. 9 is a flowchart illustrating an option I/F task for notifying the option controller 106 of information such as the condition of the page specified by the scheduling task, and reinstructions from the engine I/F task, and other tasks. The option I/F task is executed by the video controller 103. In step S901, if a page instructed by the scheduling task to be printed is detected, the option I/F task monitors the condition of the page (step S902). At this time, if printed pages are detected, the option I/F task gives the scheduling task of permission to eliminate the information. If a page instructed to be printed is not detected, the option I/F task does not monitor page condition, but rather proceeds to step S903.

The option I/F task monitors the movable positions of the discharging bins (and whether the discharging bins are being moved) (step S903). The option I/F task monitors abnormal conditions such as paper end, paper jam, a full stack (step S904), and notifies a necessary task to perform operator call displaying, reinstruction executing, etc. In step S905, the option I/F task monitors and updates conditions such as the remaining amount of paper in the paper-feeding option unit 107, the stacked-paper amount of paper in the discharging option unit 108, and the remaining amount of staples. The option I/F task is notified of a reinstruction from the engine I/F task to determine whether reinstruction data is detected (step S906). If the reinstruction data is detected, the option I/F task sends a reinstruction to the option controller 106, based on the reinstruction data (step S907), and the engine I/F task executes printing based on the reinstruction. The reinstruction is caused by a feeding system change due to paper end, and a discharging-bin change due to a full stack in the discharging bin. The present instructions are switched.

Figure 10:
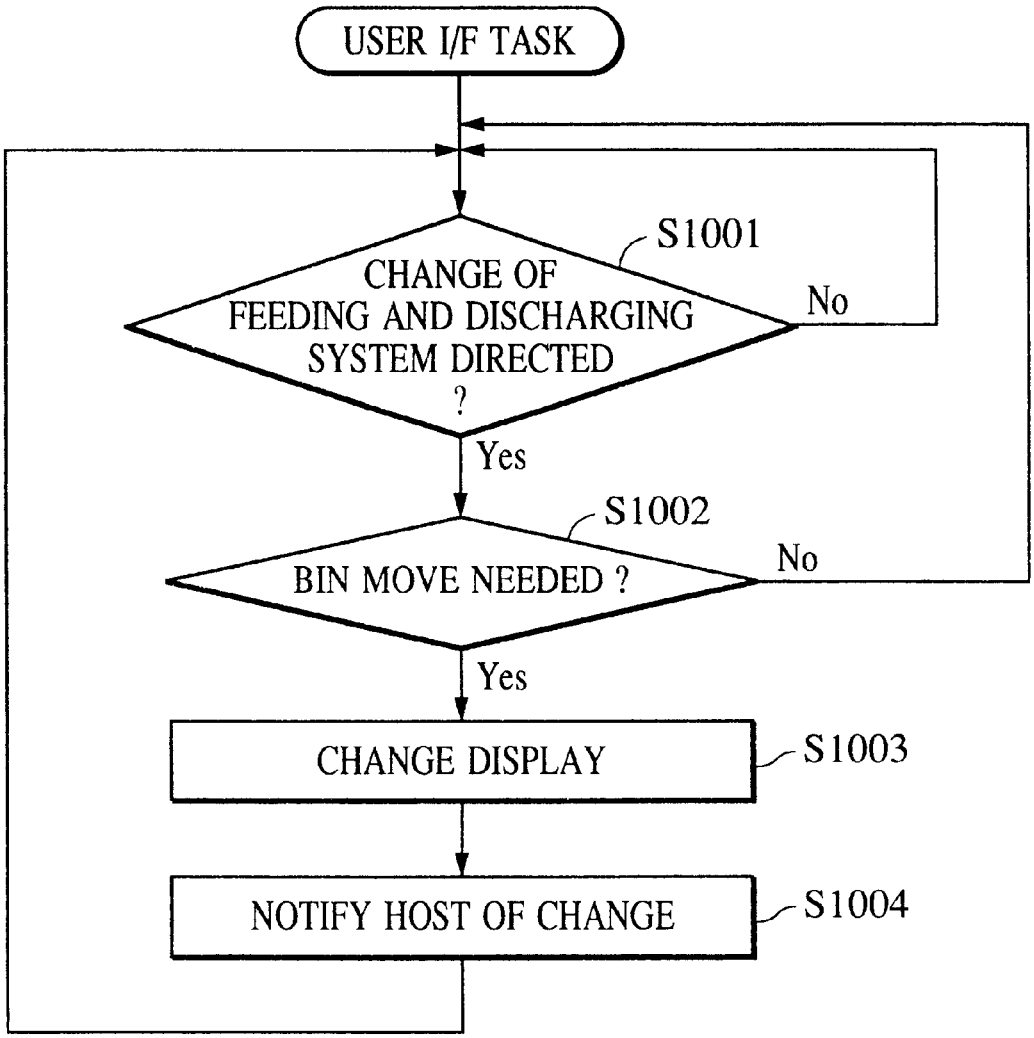
FIG. 10 is a flowchart showing a process for notifying a user of a paper feeding-and-discharging system in remote control from panel operation and a host computer.
Figure 11A:
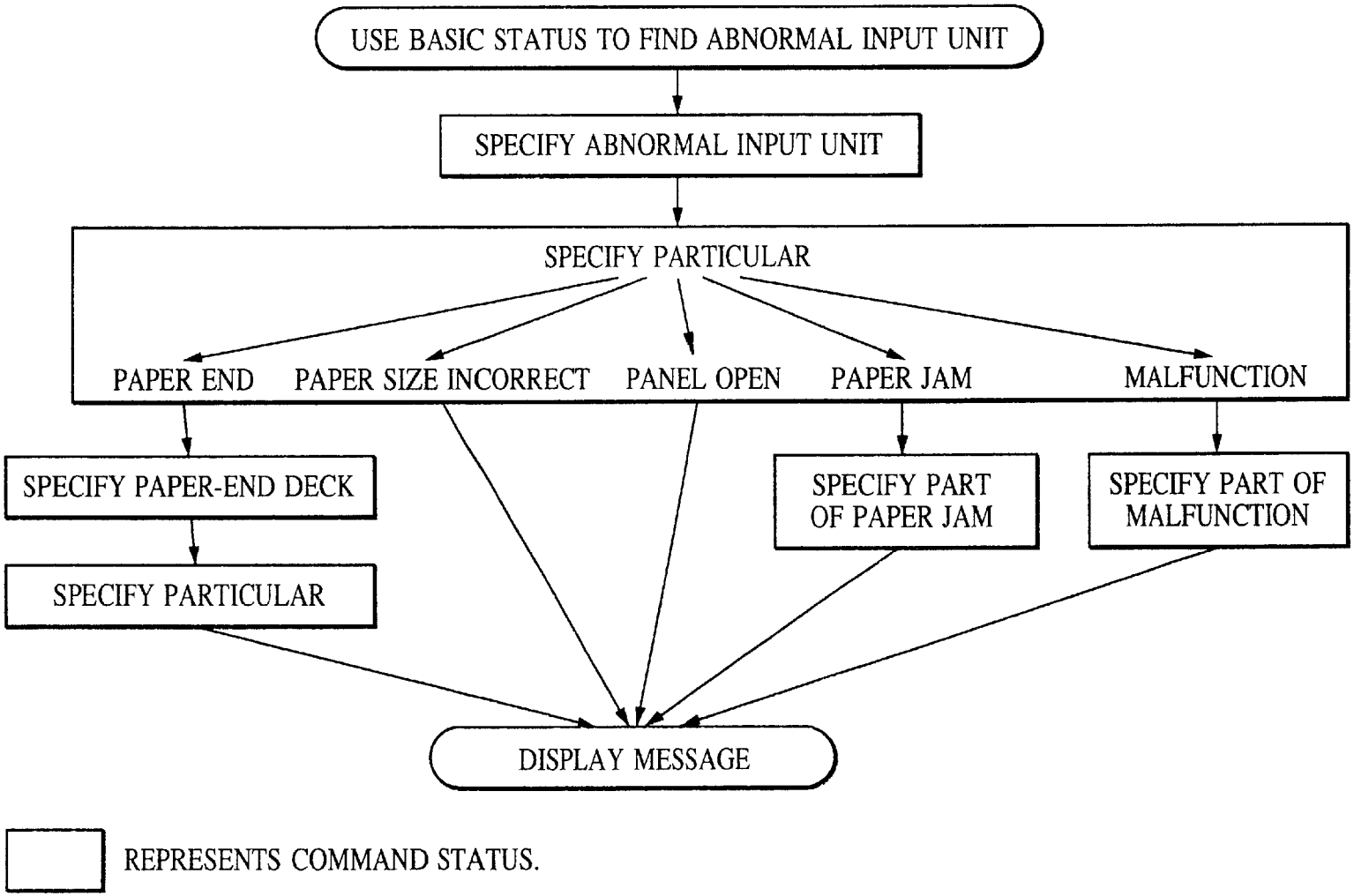
FIG. 11A is a schematic chart showing a procedure in which a command status is issued based on a basic status to obtain detailed information on each input option.
Figure 11B:
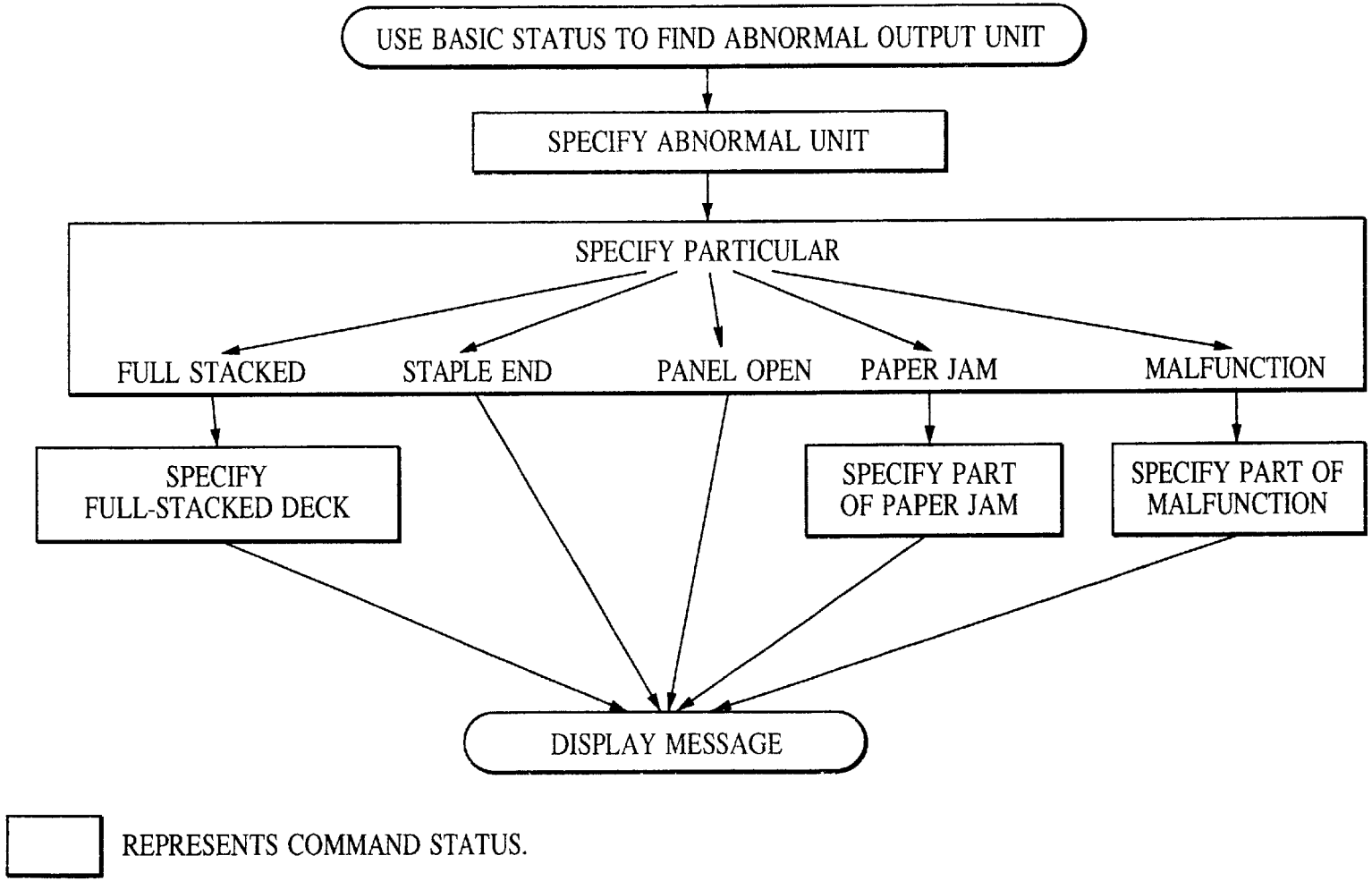
FIG. 11B is a schematic chart showing a procedure in which a command status is issued based on a basic status to obtain detailed information on each output option.

FIG. 10 is a flowchart illustrating a user I/F task for notifying a user of a feeding and discharging system change caused by the reinstruction in accordance with remote control from panel operation and the host computer 101. The user I/F task is executed by the video controller 103.

In FIG. 10, when the user I/F task detects an instruction by panel operation or remote control from the host computer 101 (step S1001), it determines whether discharging-bin moving must be performed based on the instruction, which is different from the present bin instruction (step S1002). Only when discharging-bin moving is performed, light-emitting-diode or liquid-crystal-device indications related to the feeding and discharging system are changed (step S1003). The user I/F task notifies the host computer 101 of the feeding-and-discharging-bin change (step S1004).

In the foregoing embodiments, a discharging-bin change has been described. However, similar processing may be performed for a movable feeding cassette, or a function in which another type of moving enables detection.

Although the above-described tasks are stored in the ROM 404, they may be down-loaded from the external unit 101 to a non-volatile RAM in the video controller 103, or they may be installed from a recording medium such as a floppy disc or a CD-ROM to the non-volatile RAM in the video controller 103.

As described above, in the case where a sheet stacking means is changed, a moving means moves the sheet stacking means and detection means detects the sheet-stacked condition of the sheet stacking means before image formation by image forming means is started. Thus, in a low-cost aimed image forming apparatus in which detection means detects the sheet-stacked conditions of a plurality of sheet stacking means, the present invention prevents defects generated when the stacked-paper amount of the selected sheet stacking means is controlled based on previously detected results.

What is claimed is:

1. An image forming apparatus comprising:

image forming means for forming images on sheets;

a plurality of sheet stacking means in which the sheets are stacked;

selector means for selecting one of the plurality of sheet stacking means;

moving means for moving to a predetermined position the selected sheet stacking means;

detection means for detecting a sheet-stacked condition of the selected sheet stacking means which positions at the predetermined position;

wherein said detection means utilizes a single detector common to said plurality of sheet stacking means; and control means for controlling image forming to a sheet which is to be discharged to said selected stacking means in accordance with a detected result by said detection means;

wherein said control means, when the selected sheet stacking means is changed to a newly selected sheet stacking means, causes to move the newly selected sheet stacking means to the predetermined position and to detect the sheet-stacked condition of the newly selected sheet stacking means which positions at the predetermined position and then, controls the starting of image forming to a sheet which is to be discharged to the newly selected sheet stacking means.

2. An image forming apparatus according to claim 1, wherein the sheets on which the images are formed by said image forming means are stacked by said plurality of sheet stacking means.

3. An image forming apparatus according to claim 1, wherein said selector means selects one of the plurality of sheet stacking means in accordance with an instruction from an external unit.

4. An image forming apparatus according to claim 3, further comprising notification means for notifying said external unit of the sheet-stacked condition detected by said detection means.

5. An image forming apparatus according to claim 3, wherein said external unit is notified of the sheet stacking means selected by said selector means.

6. An image forming apparatus according to claim 3, wherein said image forming apparatus has a first mode for stacking the sheets by the sheet stacking means selected by said external unit, and a second mode for stacking the sheets by the sheet stacking means automatically selected by said image forming apparatus, and said image forming apparatus further comprises information providing means used such that, in the second mode, when the selected sheet stacking means is changed to a newly selected sheet stacking means, said moving means moves the newly selected sheet stacking means to the predetermined position, and said detection means detects the sheet-stacked condition of the newly selected sheet stacking means, whereby said information providing means urges sheet removal depending on the detected sheet-stacked condition.

7. An image forming apparatus according to claim 1, wherein said detection means detects the amount of the stacked sheets in said plurality of sheet stacking means.

8. An image forming apparatus according to claim 1, wherein said detection means detects that each sheet stacking means is fully stacked.

9. An image forming apparatus according to claim 1, further comprising display means for displaying which one of said plurality, of sheet stacking means is selected by said selector means.

10. An image forming method comprising the steps of:

forming images on sheets;

selecting any one of a plurality of sheet stacking means;

moving the selected sheet stacking means to a predetermined position;

detecting sheet-stacked condition of the selected sheet stacking means which positions at said predetermined position by using a detection means;

wherein said detection means utilizes a single detector common to said plurality of sheet stacking means; and controlling image forming to the sheet which is to be discharged to said selected stacking means in accordance with a detected result in said detecting step;

wherein said controlling step, when the selected sheet stacking means is changed to a newly selected sheet stacking means, causes to move the newly selected sheet stacking means to the predetermined position, and to detect a sheet-stacked condition of the newly selected sheet stacking means which positions at the predetermined position and then, controls the starting of image forming to a sheet which is to be discharged to the newly selected sheet stacking means.

11. A method according to claim 10, wherein the sheets on which the images are formed are stacked by said plurality of sheet stacking means.

12. A method according to claim 10, wherein said selecting step selects one of the plurality of sheet stacking means in accordance with an instruction form an external unit.

13. A method according to claim 12, further comprising notifying said external unit of the sheet-stacked condition.

14. A method according to claim 12, wherein said external unit is notified of the sheet stacking means selected.

15. A method according to claim 10, wherein said detecting step detects the amount of the stacked sheets in said plurality of sheet stacking means.

16. A method according to claim 10, wherein said detecting step detects whether each one of said plurality of sheet stacking means is fully stacked.

17. A method according to claim 10, further comprising displaying which one of said plurality of sheet stacking means is selected.

18. A stacker comprising:

stacking means for stacking sheets on which images are formed;

discharging control means for performing a first mode for discharging a sheet to said stacking means in the image formed face-down condition and a second mode for discharging the sheet to said stacking means in the image formed face-up condition;

detection means for detecting an amount of the sheets stacked on said stacking means; and full-stack detecting means for detecting a full stack of the sheets on said stacking means by determining whether the amount of the sheets detected has reached a predetermined value wherein the predetermined value in the second mode is less than the predetermined value in the first mode.

19. An image forming apparatus comprising:

image forming means for forming images on sheets;

a plurality of sheet stacking means for stacking the sheets;

control means for activating a first mode in which the sheets are stacked on the sheet stacking means are selected by an external unit, and a second mode in which the sheets are stacked on the sheet stacking means are automatically selected by said image forming apparatus; and information providing means for giving information urging sheet removal, when a sheet exists in a newly selected sheet stacking means, in the case where the selected sheet stacking means is changed to a newly selected sheet stacking means, wherein said information providing means gives the information in the second mode, and does not give the information even if the sheet exists in the newly selected sheet stacking means, in the first mode.

20. An image forming apparatus according to claim 19, wherein said image forming apparatus automatically selects another sheet stacking means when the selected sheet stacking means is fully stacked in the second mode.

21. A sheet stacking method comprising:

stacking sheets on which images are formed on a stacking means;

performing a first mode for discharging a sheet to said stacking means in the image formed face-down condition and a second mode for discharging the sheet to said stacking means in the image formed face-up condition;

detecting an amount of the sheets stacked on said stacking means; and detecting a full stack of the sheets on said stacking means by determining whether the amount of the sheets detected becomes a predetermined value, wherein said predetermined value in the second mode is less than said predetermined value in the first mode.

22. A control method of an image forming apparatus comprising:

forming images on sheets;

stacking the sheets on a plurality of sheet stacking means;

activating a first mode in which the sheets are stacked on the sheet stacking means are selected by an external unit, and a second mode in which the sheets are stacked on the sheet stacking means are automatically selected by said image forming apparatus; and giving information urging sheet removal, when a sheet exists in a newly selected sheet stacking means, in the case where the selected sheet stacking means is changed to a newly selected sheet stacking means, wherein, said information providing step gives the information in the second mode, and does not give the information even if the sheet exists in the newly selected sheet stacking means, in the first mode.

23. A method according to claim 22, wherein said image forming apparatus automatically selects another sheet stacking means when the selected sheet stacking means is fully stacked in the second mode.

* * * * *

UNITED STATES PATENT AND TRADEMARK OFFICE

CERTIFICATE OF CORRECTION

PATENT NO. : 6,422,557 B1
DATED : July 23, 2002
INVENTOR(S) : Nobuyoshi Kakigi

It is certified that error appears in the above-identified patent and that said Letters Patent is hereby corrected as shown below:

Column 5,
Line 63, “amount” should be deleted.

Column 6,
Line 9, “paper.” should read -- paper --.
Line 10, “S the” should read -- S in the --.

Column 7,
Line 7, “for” should read -- for a --.
Line 34, “20” should be deleted.

Column 8,
Lines 48 and 49, “PCNG” should read -- SPCNG --.

Column 9,
Line 13, “PCNG” should read -- SPCNG --.

Column 11,
Line 28, “to be” should read -- is to be --.

Column 12,
Line 62, “of” should be deleted.
Line 66, “of the” should read -- of the movable --.

Column 15,
Line 18, “form” should read -- from --.

Signed and Sealed this

Fourth Day of February, 2003

JAMES E. ROGAN
*Director of the United States Patent and Trademark Office*